US005083772A

United States Patent [19]

Brown

[11] Patent Number: 5,083,772

[45] Date of Patent: Jan. 28, 1992

[54] EXERCISING APPARATUS

[76] Inventor: Lawrence G. Brown, 1629 Kuhilani St., Honolulu, Hi. 96821

[21] Appl. No.: 17,599

[22] Filed: Mar. 5, 1979

Related U.S. Application Data

[63] Continuation-in-part of Ser. No. 933,470, Aug. 14, 1978, Pat. No. 4,441,705.

[51] Int. Cl.[5] ..... A63B 49/00

[52] U.S. Cl. ..... 272/73

[58] Field of Search ..... 272/73

[56] References Cited

U.S. PATENT DOCUMENTS

| | | | |
|---|---|---|---|
| 351,311 | 10/1886 | Conkling | 272/73 |
| 642,919 | 2/1900 | Nott | 272/73 |
| 2,788,211 | 4/1957 | Ivanoff | 272/73 |
| 2,805,860 | 9/1957 | Littig | 272/73 |
| 3,107,915 | 10/1963 | Looney | 272/73 |
| 3,511,097 | 5/1970 | Gorwin | 272/73 |
| 3,767,195 | 10/1973 | Dimick | 272/73 |

FOREIGN PATENT DOCUMENTS

| | | | |
|---|---|---|---|
| 407263 | 3/1934 | United Kingdom | 272/73 |

*Primary Examiner*—Danton D. DeMille
*Assistant Examiner*—Arnold Kramer
*Attorney, Agent, or Firm*—Klaas & Law; Bruce G. Klaas

[57] ABSTRACT

Exercising apparatus for simulating the characteristics of exercise during actual riding of a bicycle comprising a stationary frame device for mounting apparatus components comprising a pedal operated drive system, fly wheel apparatus of relatively small size and weight operatively associated with the drive system and being operable thereby at relatively high velocities simulating momentum during actual riding of a bicycle, and resistance load applying apparatus operatively associated with the drive system for automatically applying variable resistance loads to the drive system in direct proportion to velocity of the drive system to simulate variations in resistance load encountered during actual riding of a bicycle.

51 Claims, 8 Drawing Sheets

Fig-9
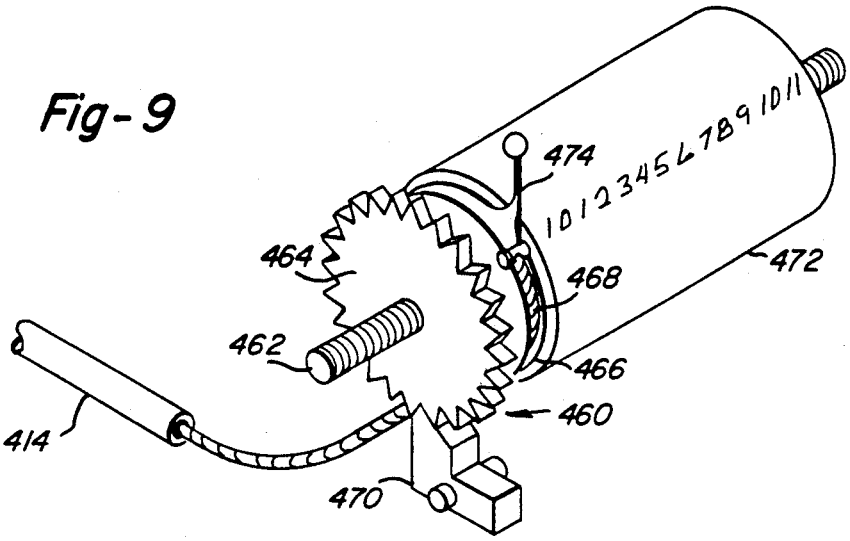
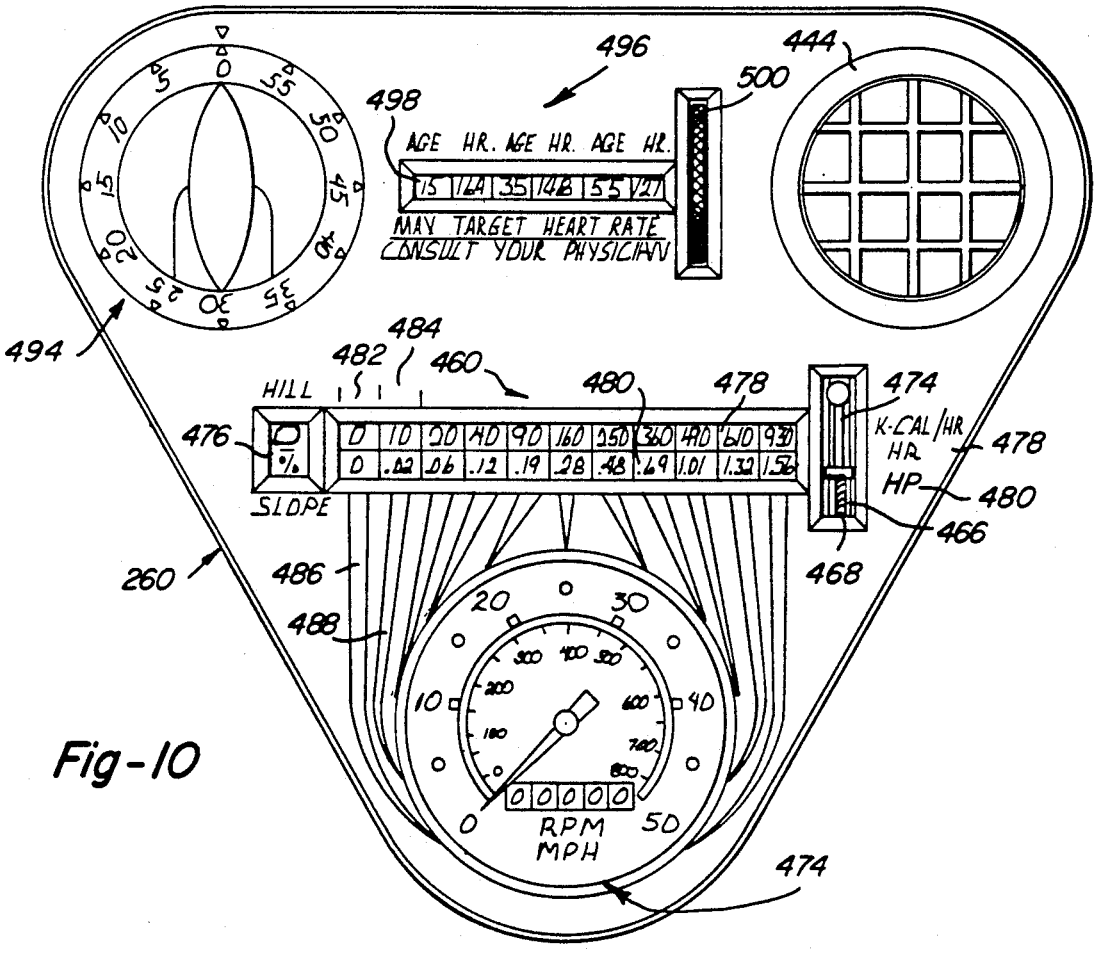
Fig-10

EXERCISING APPARATUS

BACKGROUND AND SUMMARY OF INVENTION

This invention relates generally to bicycle-type stationary exercise apparatus which involves the use of rotatable crank arms with pedals, such as used on bicycles, operably connected to a bicycle drive system subject to a variable load. Such apparatus has been known and used for many years in gymnasiums, health clubs and homes.

This application is a continuation-in-part of my prior U.S. patent application Ser. No. 933,470 filed Aug. 14, 1978, now U.S. Pat. No. 4,441,705, for Exercising Apparatus, the benefit of the filing date of which is claimed herein.

A primary object of the present invention is to provide new and improved bicycle type exercise apparatus which is capable of simulating the characteristics of exercise during the actual riding of a bicycle. Such characteristics of exercise during actual riding of a bicycle include, among other things, variations in wind resistance dependent upon the speed of the bicycle and riding conditions; variations in force of momentum dependent upon the speed of the bicycle and the weight of the rider; and variations in load dependent upon topography, i.e. uphill, downhill and level riding conditions. At the present time cycling has become a very popular sport for both recreational riders and for large numbers of racing and cross-country bicycling enthusiasts. Indeed, the health benefits of both actual bicycle riding and the use of stationary bicycle-type exercise apparatus have been long recognized by health authorities and the general public.

Some of the drawbacks of prior stationary bicycle-type exercise apparatus have included lack of similarity to actual bicycle riding conditions as well as relatively high cost of manufacture and bulkiness of the apparatus.

The apparatus of the present invention enables substantial duplication of actual bicycle riding conditions whereby the same body muscles are used in substantially the same way as doing actual bicycle riding. The duplication of actual bicycle riding conditions is of substantial benefit to all bicycle riders but is of particular importance to those bicycle riders who desire to train for particular bicycle riding situations such as for various kinds of bicycle racing and cross-country events. In addition, an important use of the present invention is as a rehabilitation exerciser device for physically handicapped persons. In this connection, the present invention enables smooth continuous uniform rotation and loading through each 360° crank shaft rotational cycle without the usual loss of momentum and velocity in the vertical crank arm positions of conventional bicycle type exercising apparatus.

The present invention enables the use of both (1) a self-contained type exercise apparatus including permanently mounted bicycle-type parts; and (2) a bicycle mounting type exercise apparatus which is adapted to employ portions of an actual bicycle thereby reducing cost and enabling use of bicycles already owned and actually used by the exerciser for bicycle riding. In the second form of the invention, the construction and arrangement of the exercise apparatus is such as to enable mounting of a conventional bicycle on the exercise apparatus by the simple expedient of removing the front wheel of the bicycle.

Both types of exercise apparatus are particularly adapted to use with variably selectable multiple speed bicycle type drive systems, such as presently commercially available three speed, five speed or ten speed drive systems or, more preferably, a drive system of the type disclosed in my U.S. Pat. No. 4,133,550 issued Jan. 9, 1979, for Bicycle And Power Transmission System, the disclosure of which is incorporated herein by reference. Each type of exercise apparatus comprises a relatively small size and weight fly wheel means driven at relatively high velocities by the drive system for energy storage to simulate inertial and momentum forces during actual riding of a bicycle; an automatically variable resistance load applying means driven by the drive system for automatically applying continuously variable resistance loads directly proportional to drive system velocity t simulate variations in resistance loads encountered during actual riding of a bicycle at varying velocities; and selectively changeable fixed resistance load applying means for selectively applying variable fixed resistance loads to the drive system to simulate fixed resistance loads variously encountered under actual bicycle riding conditions. Each type of exercise apparatus further comprises controls and instrumentation for selective simulation of particular actual bicycle riding conditions and display for the exerciser of various exercise conditions.

The bicycle mounting type exercise apparatus comprises a stationary frame means in the form of an elongated tubular bottom member having laterally extending stabilizer members mounted thereon. An upwardly extending mounting post is provided at the front end of the bottom member to receive and support the front wheel fork of a bicycle. An upwardly extending central support means is provided on the bottom member to receive and support the crank shaft hub portion of the bicycle. A rotatably driven friction wheel member is centrally mounted on a shaft member supported by mounting bracket members on a rear portion of the bottom member or by the central support means for frictional driven engagement with the rear wheel of the bicycle to apply load thereto simulating actual bicycle riding conditions. A flywheel device is mounted on one end of the shaft member or on another shaft member in centrally located housing means to simulate momentum forces and a continuously variable air resistance device is mounted on the other end of the shaft member or in the centrally located housing means to simulate air resistance forces. A variable fixed load applying device is associated with the driven friction wheel member to simulate variable gravity and ground resistance force encountered during actual bicycle riding. Suitable instrumentation and display means are provided to accurately display various exercise conditions.

BRIEF DESCRIPTION OF DRAWING

FIG. 9 is a perspective view of another portion of the apparatus of FIG. 7;

FIG. 10 is an enlarged plan view of an instrumentation housing and display apparatus shown schematically in FIG. 7;

DETAILED DESCRIPTION

Figure 1:
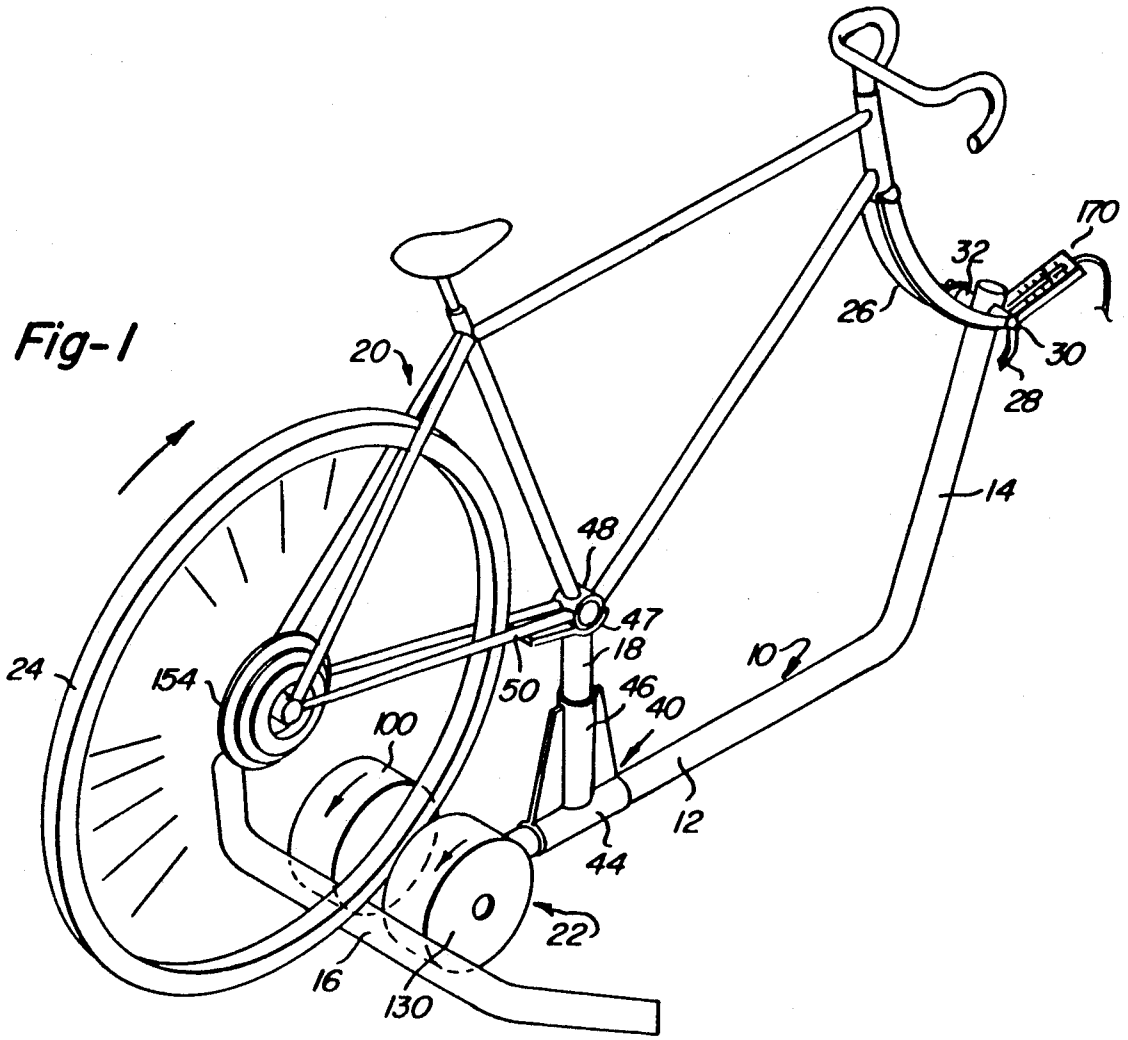
FIG. 1 is a schematic perspective view of one embodiment of the present invention showing an actual bicycle, with parts removed, mounted on exercise apparatus of the present invention.

Referring to FIG. 1, in general, the exercise apparatus of the present invention comprises a stationary support frame means 10 having a main elongated horizontally extending bottom support member 12 with an upwardly extending front end support portion 14; a rear laterally extending stabilizer member 16; and a central upwardly extending support member 18 for supporting a bicycle 20, with the front wheel removed, in a vertical upright attitude. A variable load applying means 22 is mounted on the support member 12 of the support frame means 10 for driveable engagement with the rear wheel 24 of the bicycle 20.

The frame means 10 is preferably made of tubular metallic material such as steel or aluminum. The support member 12 and the stabilizer member 16 may be permanently fastened together as by welding or may be made as separable sections connected by threaded fasteners or the like to facilitate shipping and storage. The front end support portion 14 may be integral with the bottom member 12 as illustrated or may be a separate member suitably attached thereto by threaded fasteners or the like (not shown) for ease of shipping and storage. The size and shape of the front end support portion 14 is such as to receive and rigidly support the lower end of the fork 26 of a bicycle with the front wheel removed. A conventional quick release front wheel axle coupling 28 may be employed with a conventional front wheel axle member 30 or the like mounted in a support hub 32 and extending through aligned openings in the upper end of support portion 14. The central support member 18 is adjustably slidably mounted on the bottom member 12 by a bracket device 40 made of two half pieces secured by suitable threaded fastener devices 42 to provide a horizontal tubular portion 44 to receive bottom member 12 and a vertically extending tubular portion 46 t receive tubular member 18. A cradle member 47 is mounted on the top of the member 18 for engaging and supporting a conventional bicycle crank arm and shaft hub 48 with suitable bracket and threaded fastening devices 49 securely mounting the hub 48 on the cradle member 46 in association with the lower rearwardly extending bicycle frame members 50.

The variable load applying means 22 is slidably adjustably mounted on the bottom member 12 by suitable bracket members 60, 62 and threaded fastener devices 64, 66. The variable load applying means 22 comprises a main shaft member 68 rotatably supported by conventional bearing means 70, 72 mounted in hub portions 73, 74 in upwardly extending flange portions 75, 76 of the bracket member 60. A driven load applying wheel member 77, preferably having a high friction peripheral surface 78 of suitable material such as aluminum or rubber-like material, is fastened to shaft member 68 and is frictionally driveably engageable with the rear wheel tire 79 of the bicycle. A pair of axially spaced guide flange members 80, 82 are mounted at the sides of the wheel member 77 to confine the rear bicycle wheel therebetween. Spacer sleeve members 84, 86 are mounted between the flange members 80, 82 and the bearing means 70, 72.

A flywheel means 100 is fixedly mounted on one end of shaft member 68 for simulating the momentum forces encountered during actual bicycle riding. The flywheel means 100 of the preferred embodiment comprises a cylindrical member 102 of steel or the like having a suitable size and weight to effect the desired results. If desired, weight changing means (not shown) may be provided by suitable attachment devices on the cylindrical member 102 or the cylindrical member may be replaced by other cylindrical members of different sizes and weights.

Figure 3:
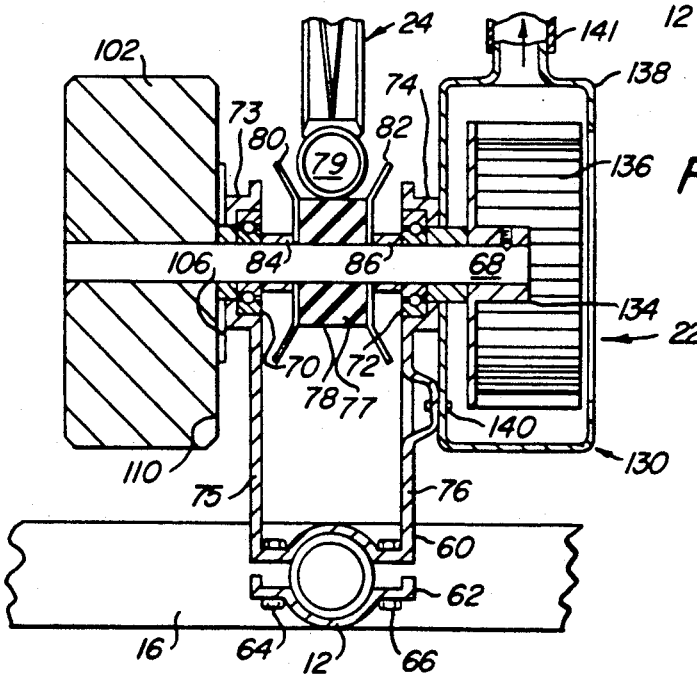
FIG. 3 is a cross-sectional view of a portion of the exercise apparatus of FIG. 1 taken along the line 3—3 in FIG. 2.
Figure 4:
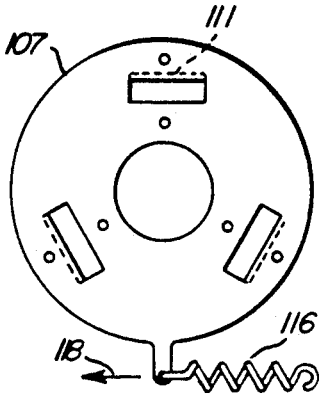
FIGS. 4 and 4a are a side elevational view and an enlarged cross-sectional view of a variable fixed load applying device utilized with the exercise apparatus of FIGS. 1-3.
Figure 5:
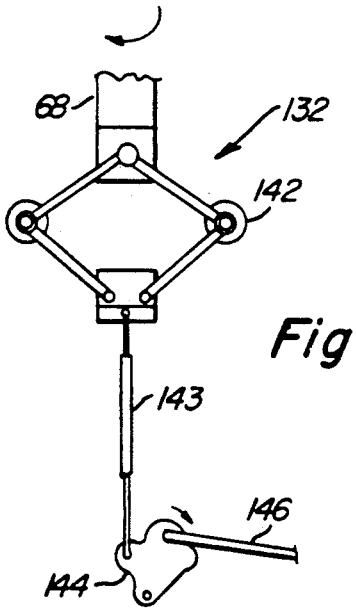
FIG. 5 is a side elevational view of a variable speed control device utilizable as an alternative embodiment with the apparatus of FIG. 4.
Figure 4A:
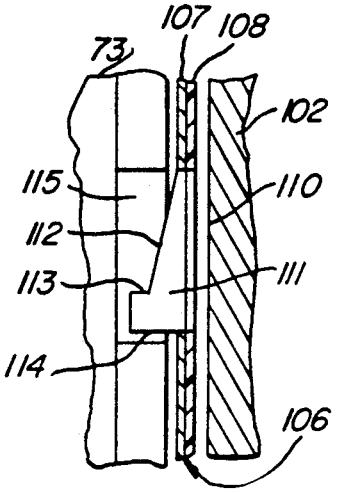

A first adjustable motion retarding fixed load applying means 106, FIGS. 3 & 4, may be associated with the flywheel member or another portion of variable load applying means 22 or the bicycle wheel to enable adjustment of motion retarding force applied to the rear wheel of the bicycle. Means 106 comprises a disc-like frictional braking device 107, FIGS. 4 & 4a, mounted circumjacent shaft member 68 for limited axial and rotative displacement relative to the hub portion 73 to cause engagement of friction means 108, in the form of a lining or pads (not shown) with side surface 110 of member 102. Three laterally extending cam tab means 111, having inclined cam surfaces 112 and stop surfaces 113, 114, are located in corresponding notches 115 in hub portion 73 for variable adjustable loading against the bias of a return spring 116 by an adjustment device such as a cable 118 or the like.

The variable load applying means 22 further comprises speed responsive load control means 130, FIGS. 1-3, or 132, FIG. 5, for automatically increasing and decreasing the load applied to the driven wheel means in accordance with the rotational speed of the rear wheel.

Figure 2:
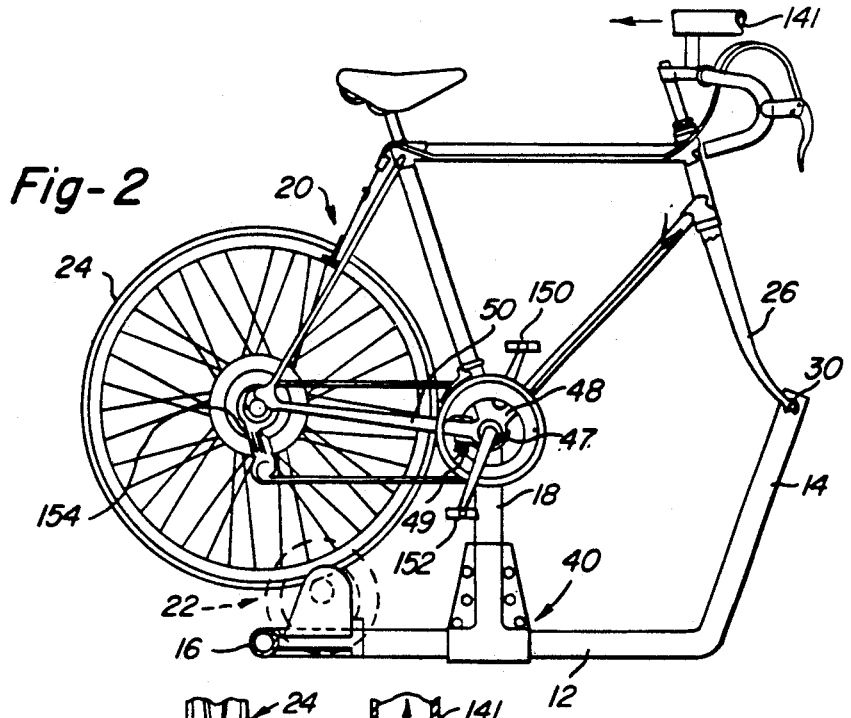
FIG. 2 is a side elevational view of the exercise apparatus of FIG. 1 with a multiple speed bicycle mounted thereon in operative position.

In the preferred embodiment of FIGS. 1-3, the load control means 130 comprises a conventional cage type rotary air blower member 134 fixedly mounted on the other end of shaft 168 opposite the flywheel means 100 with fan blade members 136 peripherally enclosed by a cylindrical housing member 138 fixedly mounted on flange portion 76 of bracket member 60 by suitable fastening means 140. The construction and arrangement is such as to provide restricted air flow through the blade members 136 so that the air resistance to rotation of the blower member 134 is proportional to the rotational speed thereof to simulate air resistance when actually riding a bicycle. In addition, if desired, a length of flexible tubing 141 ma be connected to the air chamber in housing member 138 to provide a flow of air in front of the rider simulating the air flow during actual bicycle riding. The alternative speed responsive load control means 132 of FIG. 5 comprises a conventional centrifugal control device 142 rotatable by shaft 68 to cause variable linear displacement of a control member 143 proportional to rotational speed. Control member 143 may be suitably operatively connected to braking device 107 through a pivotal connecting member 144 and a cable member 146.

In operation, a conventional bicycle may be mounted on the exercise apparatus by the simple expedient of removing the front wheel of the bicycle and mounting the bicycle in the manner previously described with such adjustments in the adjustable mounting devices as may be necessary to accommodate different makes and sizes of bicycles. When the bicycle is properly mounted, the rear tire 79 of the bicycle frictionally driveably engages the outer periphery 78 of the driven wheel member 77. When the bicycle is ridden, i.e., the foot pedals and crank arms 150, 152 are rotated, any conventional multiple speed bicycle drive system 154 is operated to cause rotation of the rear bicycle wheel of the bicycle and rotation of the driven wheel member 77. The frictional retarding force applied by the driven wheel member to the rear bicycle wheel is proportional to the effect of the various load variation devices associated with the main shaft member 68. The flywheel means 100 simulates momentum forces. The use of a suitable variable motion retarding fixed force applying means 106 enables simulation of uphill, downhill or flat riding conditions as well as any other load conditions desired by the rider. The air resistance loading means 130 provides a resistance force which is directly proportional to bicycle speed to simulate air resistance during actual bicycle riding. In addition, if the centrifugal control device 142 is utilized in connection with the brake means 107, the retarding force is automatically controlled in direct relationship to speed of rotation of the rear wheel.

Figure 6:
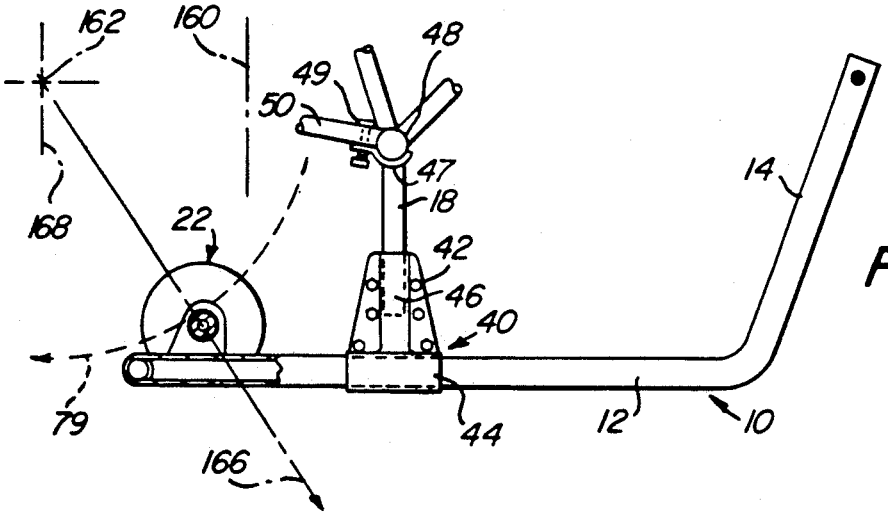
FIG. 6 is a partial side elevational view of the exercise apparatus of FIGS. 1-4 showing a portion of the bicycle apparatus mounted thereon in a preferred position.

As illustrated in FIGS. 1 & 6, the construction and arrangement is such as to require minimum space with maximum stability in use. The variable load applying means 22 is located between the rear wheel 24 and the hub 47 so that none of the exercise apparatus is located rearwardly of the rear wheel axis of the bicycle. In addition, the forwardmost portion of the exercise apparatus terminates at the front wheel axle mounting position. Not only is the length of the exercise apparatus less than the length of the bicycle, the height of the exercise apparatus is minimized with only slightly more clearance than that required for rotation of the rear wheel and pedal and crank arms being provided. In the preferred embodiment, as illustrated in FIG. 6, the lowermost portion of the rear wheel 79 of the bicycle is located in a plane substantially coplanar with the uppermost surface of the lower support member 12 which may be made of 2 inch diameter tubing material. Thus, the bicycle is mounted within approximately 2 inches or less of the normal ground engaging position during actual bicycle riding.

Maximum stability with minimum size and weight has been achieved by locating the variable load applying means 22 in relatively close proximity to a vertical plane 160 extending below the bicycle seat so that the center of gravity of the bicycle and the rider are in relatively close proximity to the variable load applying means. Thus, the stabilizer member 16 may be of relatively short length and located forwardly of the axis of rotation 162 of the rear wheel in relatively close proximity to the plane 160 of the bicycle seat between the rear wheel axis and the crank hub 48. The shape of the stabilizer member 16 may be varied as necessary or desirable and may include forwardly extending end portions, illustrated in FIG. 1, located in relatively close proximity to a vertical plane including the center of gravity adjacent the bicycle seat. The location of the variable load applying means 22 is such that the weight thereof, approximately 25 pounds, in the present preferred embodiment, is effective to provide maximum stabilization and the weight of the frame means 10 may be as low as approximately 10 pounds with use of aluminum tubular material as is presently preferred. Also, the location of the flywheel means 100 and the speed responsive resistance means 130 on opposite ends of shaft 68 provides good balance and weight distribution.

Furthermore, the location of the load applying means 22 in front of the rear wheel of the bicycle most nearly simulates actual riding conditions and assures positive driving contact between a lower front portion of the rear wheel tire 79 and the driven friction wheel 77 at 164 in the direction of a radial line 166 intersecting a vertical line 168 through the rear wheel axis of rotation at a angle of less than 45° with the angle being reduced in accordance with the mounting height of the rear wheel as illustrated in FIG. 2. Various visual gauges, such as a load indicator and/or a velocity indicator 170 may be suitably mounted on the exercise apparatus and connected to the variable load applying means 22 and/or the rear wheel of the bicycle to indicate load and/or speed.

Figure 7:
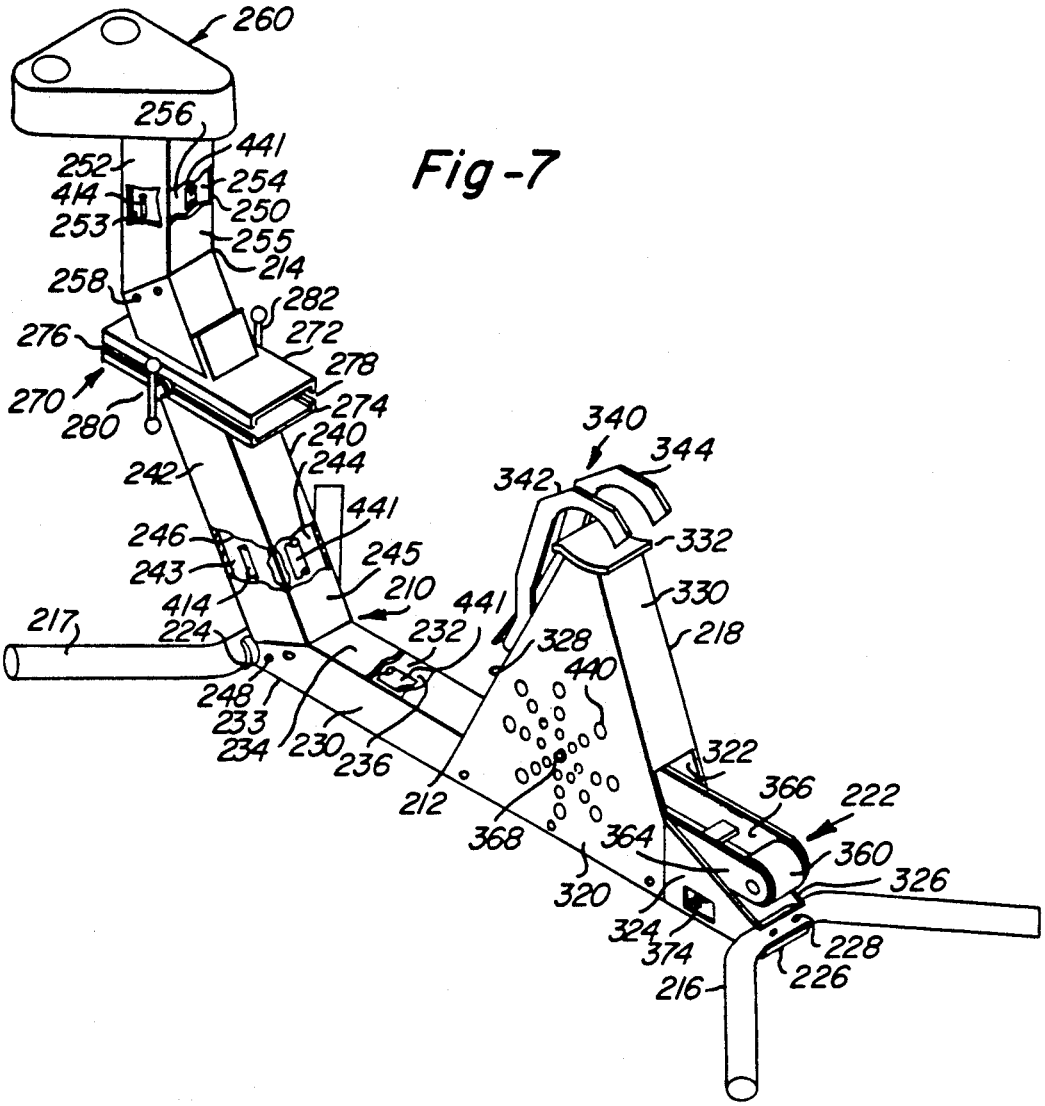
FIG. 7 is a perspective view of a presently preferred embodiment of the bicycle mounting type exercise apparatus.
Figure 8:
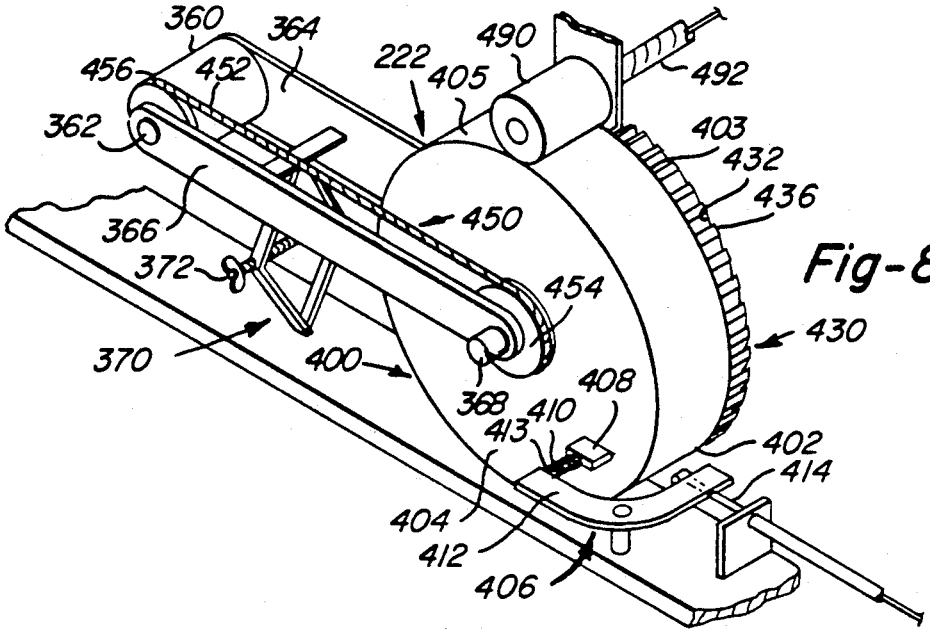
FIG. 8 is an enlarged perspective view of a portion of the apparatus of FIG. 7.

Referring to FIGS. 7–13, in general, the exercise apparatus of a presently preferred embodiment of the bicycle mounting type exercise apparatus comprises a stationary support stand means 210 having a main elongated horizontally extending bottom support means portion 212; an upwardly extending front end support post means portion 214; rear and front laterally extending stabilizer means 216, 217; and a central upwardly extending housing and support means portion 218 for supporting a bicycle (not shown) with the front wheel removed, in a vertical upright attitude as previously described. A variable resistance load applying means 222, FIG. 8, is mounted within the housing and support means portion 218 for driveable engagement with the rear wheel of a bicycle.

The stand means 210 is preferably made of metallic sheet material such as steel. The stabilizer members 216, 217 are made of one piece of formed tubular metallic material fixedly removably attached to semi-circular brackets 224, 226 welded on the ends of the bottom support means portion 212 by threaded fasteners 228 or the like to facilitate shipping and storage.

The bottom support means portion 212 comprises a front frame section having a pair of parallel vertically extending side plate members 230, 232 suitably rigidly connected by an elongated lower plate member 233, which may extend the entire length of the bottom support means portion 212, and an upper plate member 234, extending between the support means portions 214, 218, to provide an elongated control passage 236 of polygonal cross-sectional configuration. The front end support means portion 214 comprises an upwardly outwardly inclined lower frame section 240 made of rigid side plate members 242, 243, 244, 245 which define an elongated control passage 246 of polygonal cross-sectional configuration. The lower end portion of section 240 is telescopically mounted in the front end portion of the bottom support means portion 212 and suitably rigidly connected thereto as by threaded fasteners 248. The front end support means portion 214 further comprises an upwardly extending upper frame section 250 made of rigidly connected side plate members 252, 253, 254, 255 which define an elongated control passage 256 of polygonal cross-sectional configuration. The lower end portion of section 250 is telescopically mounted in the upper end portion of lower section 240 and rigidly connected thereto by suitable threaded fasteners 258. An instrument panel housing means 260 is suitably mounted on the upper end portion of upper section 250.

Figure 11:
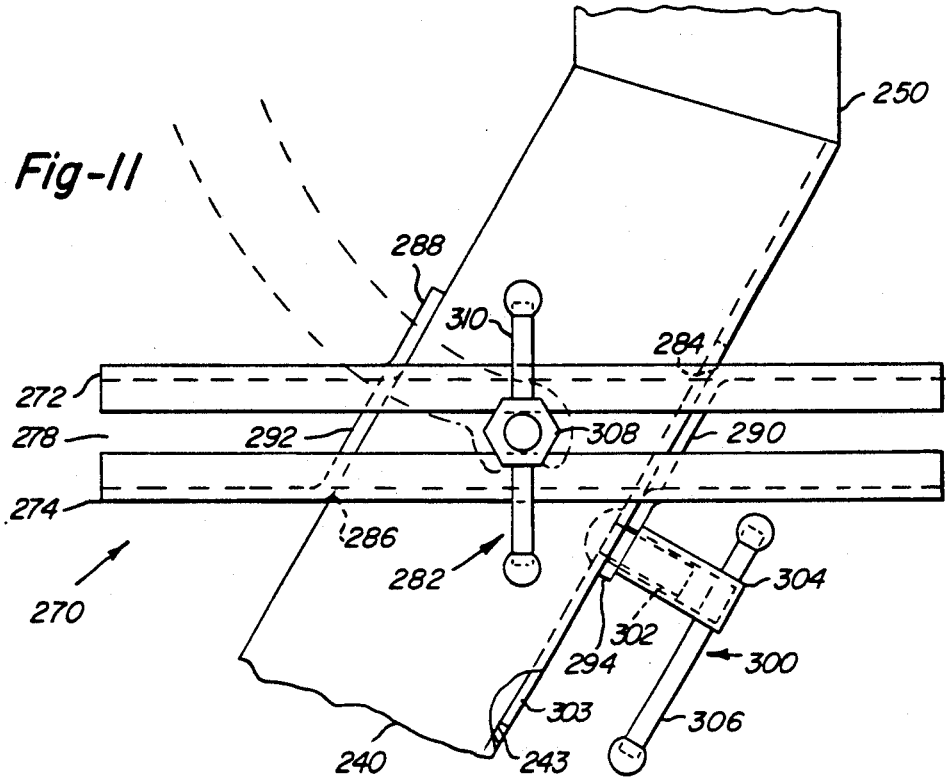
FIG. 11 is an enlarged side elevational view of a portion of the apparatus of FIG. 7.
Figure 12:
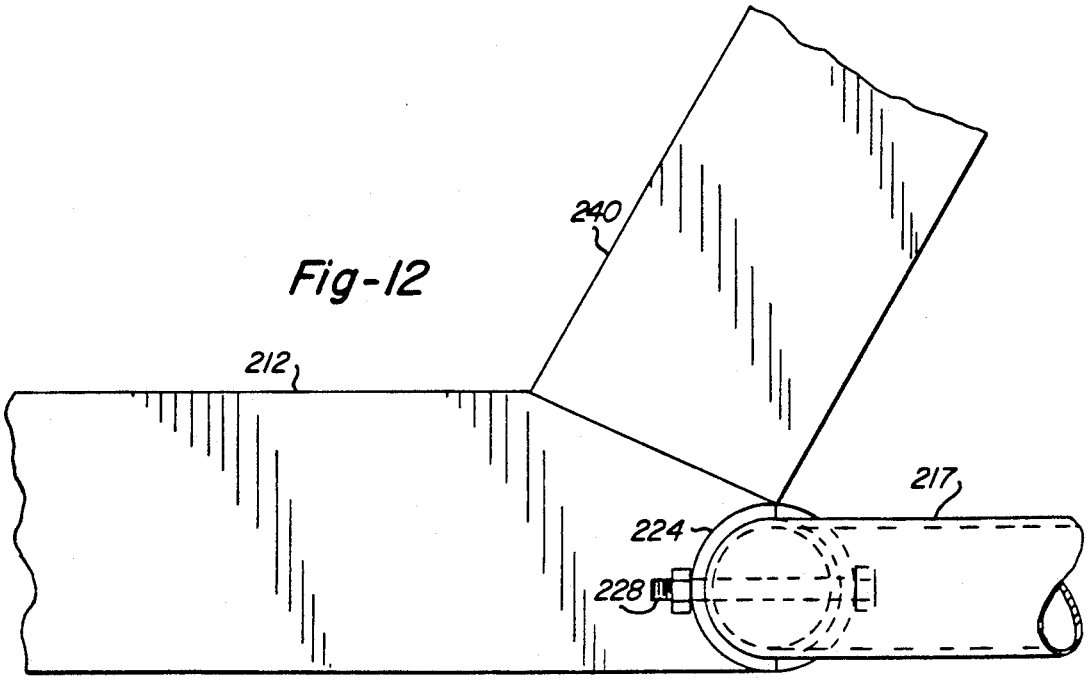
FIG. 12 is another enlarged side elevational view of another portion of the apparatus of FIG. 7.

An adjustable front wheel fork mounting means 270 is slidably adjustably mounted on the upper end portion of lower section 240 for receiving and rigidly supporting the lower end of the fork of a bicycle with the front wheel removed as illustrated in FIG. 11. The mounting means 270 comprises upper and lower channel shaped plate members 272, 274 mounted in fixed spaced relationship to define a pair of opposite elongated parallel guide slots 276, 278, FIG. 7, in which releasable and tightenable fork attachment and support means 280, 282 are slidably adjustably retained. As shown in FIG. 11, each of the plate members 272, 274 is provided with a central opening 284, 286 of polygonal configuration corresponding to the polygonal configuration of lower section 240. The openings 284, 286 are defined by opposite pairs of upwardly and downwardly turned inclined integral flange portions 288, 290 and 292, 294, respectively, which slidably abutably support the mounting means 270 on section 240 with flange portions 290, 292 being suitably fixedly connected to members 274, 272, respectively, as by welding. Vertical height adjustment and clamping means 300 are provided by a threaded fastener 302 slidably adjustably mounted in an elongated slot 303 in plate member 243 and a threaded nut device 304 operable by a handle member 306 to accommodate different size bicycles. The lateral adjustment means 280, 282 comprise similar nut members slidably mounted in slots 276, 278 with a threaded nut device 308 being operable by a handle member 310.

Figure 13:
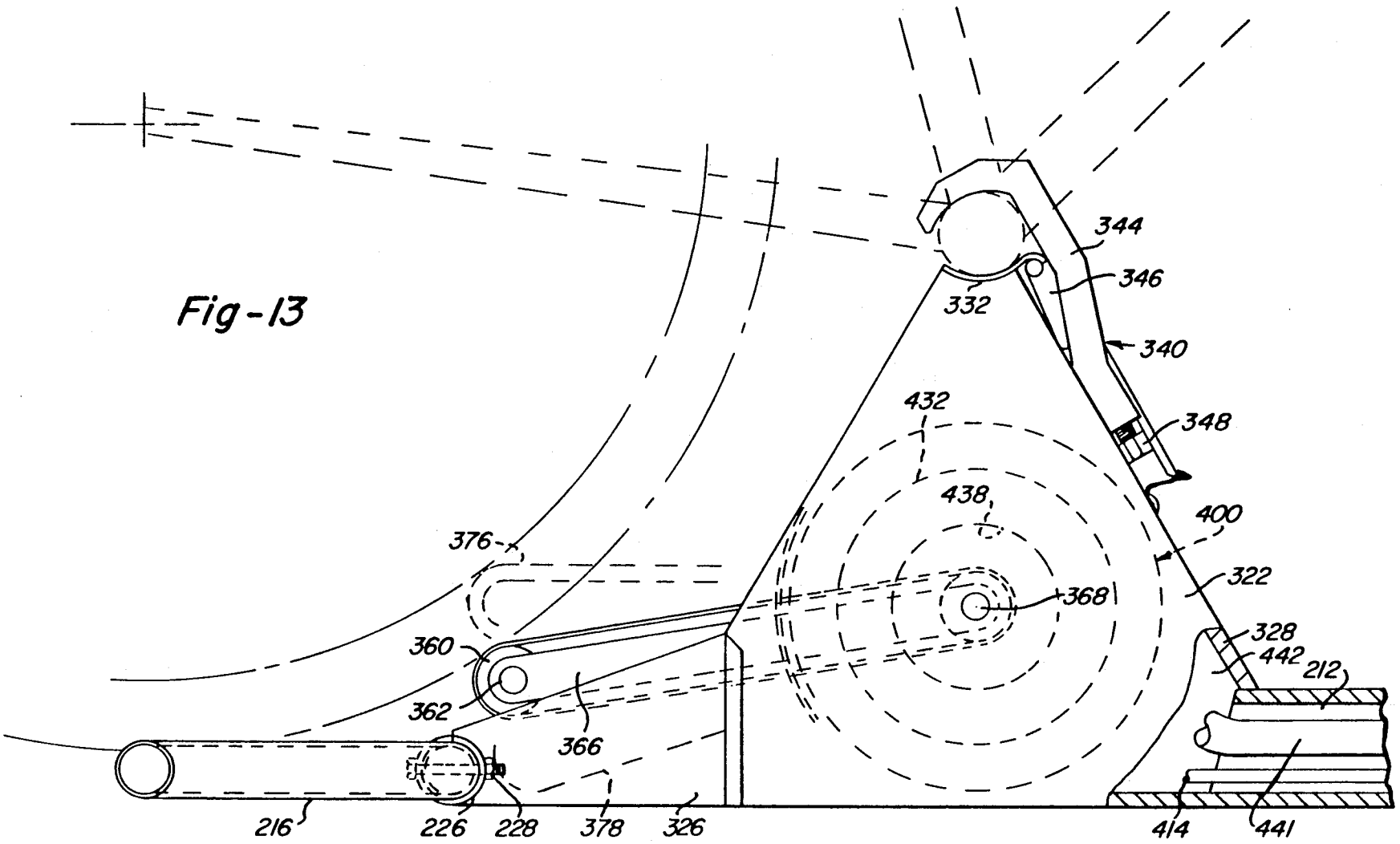
FIG. 13 is an enlarged side elevational view, partly in cross-section, of another portion of the apparatus of FIG. 7.

The central housing and support means portion 218 comprises a pair of spaced parallel generally triangular shape side plate members 320, 322 having rearwardly extending generally triangular shape flange portions 324, 326 to which rear stabilizer means 216 is attached. Plate members 320, 322 are rigidly connected by front and rear end plate members 328, 330 and support an upper cradle plate means 332 for receiving and supporting the crank shaft hub of a bicycle as previously described. A suitable releasable clamping means 340 in the form of a pair of J-shaped clamping plates 342, 344 operable between open and closed clamping positions by suitable cam means 346 and adjustment screw means 348, FIG. 13, is provided for releasably clamping the crank hub portion of the bicycle. The rear end portion of bottom frame means 212 is telescopically received between side plate members 320, 322 and suitably fixedly secured thereto.

As shown in FIGS. 7, 8 & 13, the variable resistance load applying means 222 comprises a driven wheel means 360 freely rotatably mounted on a shaft 362 supported between spaced parallel elongated rigid arm members 364, 366 selectively pivotally displaceably mounted on a shaft member 368 in housing portion 218. Wheel member adjustment means 370, in the form of a conventional scissors type jack device, are mounted beneath and operably connected to the arm members 364, 366 to enable variable adjustment by a threaded device 372, accessible through an opening 374 in rear flange portion 324, between upper and lowermost positions 376, 378 illustrated in FIG. 13 to accommodate different size bicycles and to obtain desired frictional engagement between the bicycle tire and driven wheel member 360.

A flywheel means 400 is suitably centrally rotatably mounted on shaft member 368, opposite ends of which are suitably mounted in side plate members 320, 322, for simulating the momentum forces encountered during actual bicycle riding. The flywheel means 400 of the preferred embodiment comprises a cylindrical member 402 of steel or the like, having a suitable size and weight to effect the desired results, with flat annular side surfaces 403, 404 and an annular peripheral surface 405.

As shown in FIG. 8, a selectively adjustable resistance load applying means, in the form of a frictional motion retarding means 406, is associated with the flywheel member 402 to enable selective adjustment of resistance load applied to the rear wheel of the bicycle. The motion retarding means 406 comprises a frictional braking pad device 408 mounted on a slidable shaft member 410 carried at one end of a pivotally displaceable arm member 412 for rotative displacement relative to flywheel surface 404 to cause variable retarding engagement of friction pad 408 therewith. A compression spring 413 is mounted circumjacent shaft 410 to bias the pad device 408 toward engagement with surface 404 and enable relative movement between the pad device and the operating arm 412 which is selectively adjustably actuable by an adjustment control device such as a cable 414 or the like extending to the instrument panel through the frame portions 212, 214.

The variable resistance load applying means 222 further comprises speed responsive resistance load changing means 430, FIG. 13, for automatically increasing and decreasing the resistance load applied to the driven wheel means in accordance with the rotational speed of the rear wheel. The load changing means 430 may comprise a cage type rotary air blower 432 of generally conventional design as previously described or other fluid impeller means such as a conventional fluid pump. In the presently preferred embodiment, the fluid impeller means is integrally associated with the flywheel member 402 on the annular side thereof opposite the flat side surface 404 with impeller blade members 436 peripherally mounted around an air induction chamber 438, FIG. 13, connected to atmosphere through air inlet openings 440, FIG. 7, in side plate 320. The air blower 432 is peripherally enclosed by suitable housing means (not shown). The construction and arrangement of the blade members 436 is such as to provide variable resistance to rotation of the flywheel member 402 which is proportional to the rotational speed thereof to simulate air resistance when actually riding a bicycle. In addition, if desired, the frame passages or a length of tubing 441 extending to the instrument panel through frame portions 212, 214 may be suitably connected to an air chamber 442 provided in the front lower part of housing means 218 to provide a flow of air to an air outlet 444 in the instrument panel housing in front of the rider simulating the air flow during actual bicycle riding.

The flywheel means 400 is rotatably driven by the wheel driven member 360 through flywheel drive means 450 in the form of a belt 452, a pulley member 454 mounted on shaft 368 and operably connected to flywheel member 402, and a pulley like annular groove 456 in the periphery of member 360.

Referring now to FIG. 9, the selectively adjustable variable resistance load applying means 406 is selectively operably connected to control means 460 mounted in instrument panel housing 260 by cable 414. The control means 460 comprises a shaft member 462 rotatably mounting a ratchet wheel member 464, a pulley member 466 having the cable wire member 468 connected thereto, a ratchet pawl device 470 and a drum member 472. A control lever 474 or the like is operably connected to the pulley member 466 to enable the bicycle rider to wind and unwind the cable member 468 on the pulley member 466 to thus selectively change the resistance load applied by the variable loading means 406. The drum member 472 rotates with the pulley member and is provided with indicia means on the periphery thereof calculated, constructed and arranged to display variable grade (hill slope) power output characteristics for the rider on the instrument panel in conjunction with a conventional speedometer means 474. As shown in FIG. 10, the indicia means comprises hill-slope percentage indicia 476 which indicates the resistance load applied by variable loading means 406 in direct proportion to the resistance encountered during actual bicycle riding when going up a particular grade inclined terrain. The power output characteristics displayed are precalculated kilo calories per hour indicia 478 and horsepower generated indicia 480 for each percentage slope variation position at five mile per hour speed increments between 0 and 50 miles per hour. The power output characteristic indicia for each speed are arranged in vertical columns 482, 484, etc., identified with the appropriate speed by connecting indicia 486, 488, etc., and in horizontal columns 478, 480 so as to increase from left to right in accordance with speed of rotation. Since the drum 472 is mounted in juxtaposition to the speedometer means 474, the correlation between the power output characteristics indicia and the speedometer indicia may be accomplished in a relatively simple manner. The speedometer means 474 is driven by a mechanical friction operated speedometer drive means including a friction driven roller member 490, FIG. 8, suitably mounted in engagement with the peripheral surface 405 of the flywheel member 402 and a conventional speedometer drive cable 492 extending through frame portions 212, 214 to the speedometer housing means. The speedometer means 474 may also preferably include conventional revolutions per minute and odometer means as illustrated in FIG. 10. The instrumentation panel housing means may include other instrumentation such as a conventional timer means 494, a heart rate monitor (not shown) and a maximum target heart rate selector means 496 comprising a rotatable drum member 498 operable by a thumb wheel 500 to select a column corresponding to the age of the rider with maximum target heart rate indicia being indicated in association therewith.

Figure 14:
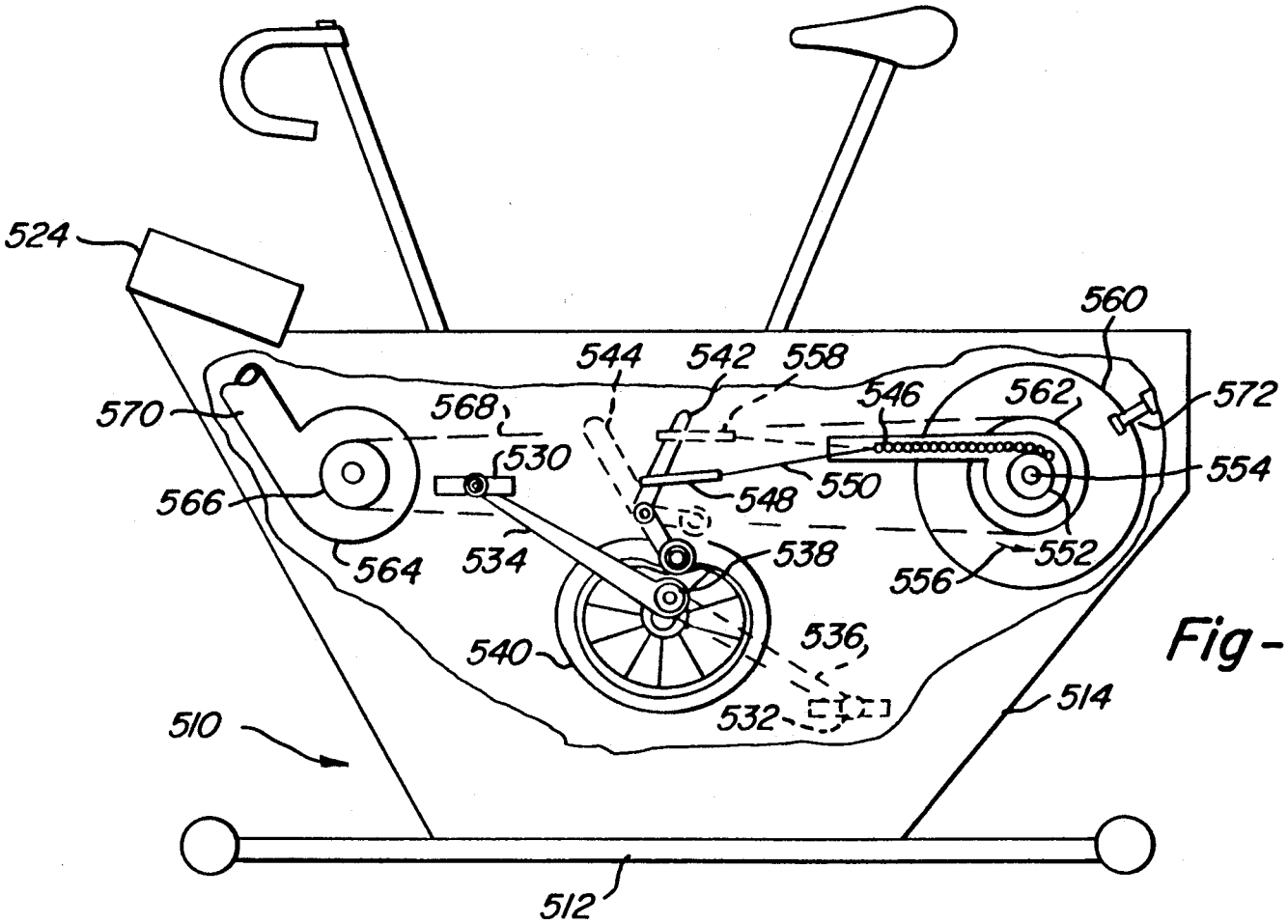
FIG. 14 is a side elevational view, with portions removed, of a self-contained type of exercise apparatus of the present invention.

Referring now to FIG. 14, an illustrative embodiment of self-contained exerciser apparatus is shown to comprise stationary support frame means 510 having an elongated horizontally extending bottom support member 512; an upwardly extending housing 514; front and rear laterally extending stabilizer members 516, 518; seat and handle bar apparatus 520, 522 suitably mounted on and extending above the housing 514; an instrument housing 524, similar to instrument housing 260 of FIGS. 7-13, suitably mounted on the front end of housing 514. An infinitely variable speed bicycle drive system of the type described in my prior U.S. Pat. No. 4,133,550 is suitably mounted in housing 514 and comprises pedal means 530, 532 on rotatable crank arm means 534, 536 operably connected to a crank shaft 538. Each pedal and crank arm has a cam member 540 (only one of which is shown) operatively associated therewith. Each cam member drives an associated oscillator member 542, 544. Each oscillator member is connected to a drive chain 546 by an adjustable positionable connecting slide member 548 and a pull rod or wire member 550. Each chain member is operatively connected to a one way drive clutch device 552 which drives a rotatable shaft 554 in the direction of arrow 556. The velocity of shaft 554 is variable relative to the velocity of the crank arms and shaft by selective radial adjustment of the slide connectors on the oscillator arms by suitable control means (not shown) between a radially innermost low gear position shown by connector 548 in FIG. 14 and a radially outermost high gear position shown in phantom at 558. Additional speed multiplicator means (not shown) may be utilized as described in my prior patent.

A flywheel means 560 and a pulley means 562 are mounted on and connected to shaft 554 for rotation therewith. A variable resistance load applying fan means 564 and drive pulley means 566 are mounted at the front end of housing 514. A drive belt 568 driveably connects pulley means 562 & 566. The outlet 570 of fan means 564 is connected by suitable passage means to air outlet means (not shown) in the instrument housing as previously described. A selectively adjustable fixed resistance load applying means 572 is suitably associated with the flywheel means as previously described and suitable controls (not shown) are connected thereto.

In operation, the flywheel means is continuously rotated by the bicycle drive system for energy storage to simulate inertial forces involved in the actual riding of a bicycle. The design characteristics of the flywheel means are such as to provide for energy storage approximating the actual inertial forces caused by the combined weight of a rider and a bicycle at particular riding velocities. For example, assuming a combined weight of 180 pounds, the fly wheel member 402 has a diameter of approximately 8 inches, a width of 1 inch, and a mass of approximately 14 pounds with a minimum flywheel-crank arm velocity ratio of approximately 50:1. The inertial design characteristics of the flywheel means of the present invention may be varied in accordance with a particular rider and bicycle weight to be matched, such as for example, between approximately 75 pounds or less for a child to 275 pounds or more for an adult, while still resulting in the provision of relatively high energy storage flywheel means of relatively small size. The arrangement and construction is specially calculated and designed to provide an automatically variable relatively high inertial force continuously uniformly applied to the bicycle drive system while being continuously variable in direct relationship to the rotational velocity of the drive system for relatively closely approximately simulating the actual inertial forces generated by a bicycle rider during actual riding of a bicycle.

The automatically continuously variable resistance load applying means is also continuously rotated by the drive system of the exercise apparatus. The arrangement and construction is specifically calculated and designed to provide an automatically variable resistance force continuously effective on the drive system and being continuously variable in direct relationship to the rotational velocity of the drive system for relatively closely approximating actual resistance forces encountered by a bicycle rider during actual riding of a bicycle. In the presently preferred embodiment, the calibration and design is based upon actual wind tunnel test results as to actual air resistance forces encountered during actual riding of a bicycle.

In addition, the selectively variable resistance load means is continuously operatively associated with the drive system of the exercise apparatus. The arrangement and construction is specifically calculated and designed to provide a selectively variable resistance force effective on the drive system for further relatively closely approximating the actual resistance forces encountered by a bicycle rider during actual variable grade downhill and uphill bicycle riding conditions. The construction and arrangement of the braking apparatus 406, in conjunction with the automatically continuously variable resistance load means; is such as to provide a combined resistance force which may be selectively varied to be equivalent to 0° (i.e. level terrain) slope actual bicycle riding resistance characteristics or various uphill (eg +10° slope) and, if desired, may be constructed and arranged to also provide downhill (eg −10° slope) actual bicycle riding resistance characteristics, the brake pad 408 being in resistive engagement with flywheel surface 404 at the 0° slope condition with the amount of resistive engagement being selectively increased for positive slope condition and decreased for negative slope conditions.

During operation of the drive system, the exercise conditions and results ar accurately visually displayed under all simulated actual bicycle riding conditions including velocity attained and power exerted and calories expended by the rider at all velocities. In addition, the instrumentation may include timing devices, heart rate monitor apparatus, target heart rate information, and body cooling air flow apparatus.

The apparatus is further constructed and arranged to (a) enable the use of variable size and style bicycles; (b) reduce size and cost of manufacture; (c) enable use of any variable speed bicycle drive apparatus and (d) enable accurate simulation of actual bicycle riding characteristics in any speed provided by such apparatus. While one specific purpose is to enable stationary exercise by bicycle riders for the purpose of conditioning and training for actual bicycle riding, another important purpose and result is to enable more satisfactory and healthful exercise by all persons for general exercise purposes and for special health rehabilitation purposes. The apparatus enables permanent calibration of instruments and exercise result display apparatus, which are substantially unaffected by rotational speed, temperature and wear, etc., exercise results displayed with both the speedometer means and the power and calorie display means being directly mechanically connected to the exercise apparatus whereby the results displayed are very accurate under all conditions of usage.

In actual riding of a bicycle, the speed of movement and the work required by the rider are a function of the total amount of resistance to movement forces encountered under particular riding conditions. Total resistance to movement force is a function of inertial resistance force, inherent bicycle drive system resistance force, wheel-ground resistance force and air resistance force. The work required by the rider is a function of total resistance force, mechanical advantage of the bicycle drive system and momentum forces. Inertial resistance and momentum forces are a function of rider and bicycle weight. Resistance forces and momentum forces are variable depending upon weather conditions, road conditions and terrain, e.g., flat, uphill or, if desired, downhill. In order to provide exercising apparatus which will enable relatively close approximation of actual bicycle riding conditions, each of these variable factors should be taken into consideration.

In the present invention, each of these factors are accounted for by the provision of flywheel means for simulating inertial resistance and momentum forces at varying rotational speeds; variable resistance means for simulating resistance to movement at varying rotational speeds; and variable speed drive means for driving the flywheel means and the variable resistance means at selectable speeds, the flywheel means and the variable resistance means being calibrated and designed to simulate actual selectable riding conditions at varying rotational speeds.

In the presently preferred and illustrative embodiments of the invention, the flywheel means comprises a relatively small size and weight flywheel device which is driven a relatively high velocities to simulate inertial resistance and momentum forces of a rider and bicycle having a weight of 180 pounds. The variable resistance means comprises an automatically variable resistance device, preferably involving acceleration of mass such as air by a rotary fan or other fluid by a fluid pump, which is calibrated and designed to provide variable increasing resistance forces proportional to variable increasing rotational speeds to thereby simulate changes in resistance encountered during actual bicycle riding. The variable resistance means also comprises a variably adjustable resistance device which provides a fixed resistance at all rotational speeds to enable simulation of variations in wheel-ground resistance and ground level variations which may be encountered during actual bicycle riding.

Thus, the present invention provides bicycle type exerciser apparatus which very closely simulates actual infinitely variable bicycle riding conditions as selected by the exerciser.

In operation, the exerciser may choose to exercise at any desired rotational speed corresponding to any riding velocity to be simulated in any selected gear ratio enabled by whichever type variable speed drive system is available on a bicycle associated with the apparatus of FIGS. 1–13 or built into the apparatus of FIG. 14. The components of the exercise system are calibrated, constructed and designed so that certain velocity related forces and resistances are automatically simulated and certain ground related forces and resistances may be selectively simulated The automatically variable resistance force applying means involves the principle of mass acceleration proportional to rotational velocity of the drive system. In use of the rotary cage type air impeller unit, air is forced through the unit by the impeller blades at a velocity and with resistance to air flow which are directly proportional to the velocity of the drive system associated therewith. Thus, a mass of air is continuously accelerated by the impeller blades during rotational movement thereof. As the rotational speed of the impeller blades changes, so too will the rate of movement of air, as well as the resistance force provided thereby, be proportionately changed.

The amount of resistance to air flow is dependent upon the design and construction of the impeller unit. The design and construction of the impeller blades may be modified as necessary or desirable and adjustable blades may be used to enable selective variable adjustment thereof by the exerciser In addition or alternatively, the design and construction of the air passages may be modified as necessary or desirable and adjustable flow control means may be used to enable selective variable adjustment thereof by the exerciser. The design and construction of the illustrative embodiments of the invention are based upon prior published wind tunnel test results which are incorporated herein by reference and accompany the Prior Art Statement submitted herewith. While fluid flow devices, air or liquid, are presently preferred, any device capable of providing mass acceleration and variable resistance to movement instantaneously proportional to changes in velocity of the drive system may be used.

The flywheel means involves the principle of high speed rotation of a relatively small size and weight mass in direct substantially increased proportion to rotational velocity of the drive system. The size, weight and required increase in rotational velocity of the flywheel means may be calculated in accordance with the following principles:

1. Kinetic energy is equal to ½ the mass times the velocity squared.
2. If a disc type mass is used, rotational energy equals ½ the movement of inertia times the square of rotational velocity in radians per second.
3. Sample calculations will show that in order to be able to utilize a relatively small size and weight mass, a relatively high rotational velocity must be utilized.

For example, in order to simulate the momentum characteristics of an 180 pound rider-bicycle weight at 15 and 25 miles per hour with a 1:1 velocity ratio basis between the drive system and the flywheel means, flywheel weights of approximately 4100 pounds and 6900 pounds, respectively, would be required. On the other hand, by use of an 80:1 increase in velocity ratio between the drive system and a disc type flywheel means having a diameter of only approximately 8 inches, a width of only approximately 1 inch, and a weight of only approximately 14 pounds, will substantially simulate an 180 pound rider-bicycle weight.

The maximum weight of the flywheel means should not exceed approximately 50 pounds and, preferably, should be between approximately 5 and 20 pounds. The size, shape and weight of the flywheel is variable dependent upon the amount of the speed increase between the crank arms and the flywheel means but the diameter of the flywheel means should not exceed 30 inches. The speed increase ratio between the crank arms and the flywheel means is variable dependent upon the size, shape and weight of the flywheel; but the preferred minimum speed increase ratio for both the bicycle mounting type exerciser and the self-contained type exerciser is at least approximately 50:1 or more to achieve best results, although a minimum ratio of not less than 10:1 for the bicycle mounting type exerciser in particular may be used to achieve minimum desired results. In any event, the moment of inertia should be between a maximum of approximately 3.0 pounds feet seconds squared with approximately 0.2 pounds feet seconds squared being presently preferred in the embodiment of FIG. 14 and approximately 0.02 pounds feet seconds squared being presently preferred in the embodiments of FIGS. 1-13.

The use of the drive system of U.S. Pat. No. 4,133,550 is particularly advantageous in that it enables more work to be done per unit of time at a particular maximum heart rate which is advantageous to athletes in good condition, persons who are not in good condition, and persons with disabilities who are being rehabilitated.

While the inventive concepts have been hereinbefore described with respect to usage with a conventional bicycle mountable thereon, it is to be understood that certain of the novel features and advantages of the present invention may be utilized in a construction and arrangement involving a permanently mounted bicycle drive-type apparatus such as provided for conventional bicycle type exercising apparatus. Also, while the illustrative and presently preferred arrangement of the various load applying devices provide particularly desirable results, the devices may be modified and various combinations of such devices may be utilized as necessary or desirable. Thus, it is intended that the appended claims be construed to include alternative embodiments and modifications except insofar as limited by the prior art.

I claim:

1. Exercising apparatus comprising:

manually operated movable drive means for manual operation by a person for exercise caused by resistance to motion thereof;

stationary support stand means for mounting said manually operative drive means;

fly wheel means operatively connected to said manually operated movable drive means for energy storage and continuous application of momentum force thereto during manual operation thereof;

a manually operable variable resistance load applying means operatively connected to said manually operated drive means for continuously applying variable operator selected resistance loads thereto;

speed responsive resistance load changing means for automatically increasing and decreasing the resistance load applied to said manually operated movable drive means in accordance with the operational speed thereof;

the exercising apparatus being constructed and arranged for simulating the characteristics of exercise during the actual riding of a bicycle;

said support stand means being constructed and arranged for mounting components of a bicycle or the like including at least a frame, a seat, handle bars, a front wheel fork, a rear wheel, crank arms and pedals, and a pedal operated drive system comprising said manually operated movable drive means;

driven wheel means for frictionally engaging the rear wheel for rotation by the rear wheel to simulate engagement with the ground during the actual riding of a bicycle;

said fly wheel means being operatively connected to said driven wheel means for energy storage during rotation of the rear wheel to simulate momentum during actual riding of a bicycle; and said variable resistance load applying means being operatively connected to said driven wheel means for continuously applying variable resistance loads to said driven wheel means to simulate variations in load encountered during actual riding of a bicycle;

lower support means for supporting the bicycle components and said driven wheel means and said variable resistance load applying means;

a front support post means connected to and extending upwardly from said lower support means for supporting the bicycle front wheel fork; and crank hub support means connected to and extending upwardly from said lower support means for supporting the bicycle frame adjacent the crank arms and the pedals; and upwardly extending support means for supporting said driven wheel means and said flywheel means and said variable resistance load applying means, the rear wheel being supported by said driven wheel means;

first mounting means associated with said front support post means for releasably holding the front wheel fork of a bicycle upon removal of the front wheel of the bicycle; and second mounting means associated with said crank hub support means for releasably holding the crank hub of a bicycle thereon.

2. The invention as defined in claim 1, and wherein said speed responsive resistance load changing means comprising:

fluid impelling means connected to and being operable by said manually operated movable drive means for automatically increasing and decreasing the resistance load in response to increases and decreases in operational speed thereof.

3. The invention as defined in claim 2 and wherein said fluid impelling means comprising a cage fan unit.

4. The invention as defined in claim 2 and wherein said variable resistance load applying means further comprising:

selectively changeable motion retarding means connected to said manually operated movable drive means for selectively variably applying a selected resistance load to said manually operated movable drive means.

5. The invention as defined in claim 1 and wherein said speed responsive resistance load changing means comprising:

fluid impelling means connected to and operable by said driven wheel means and being rotatable thereby.

6. The invention as defined in claim 5 and wherein said variable resistance load applying means further comprising:

selectively changeable motion retarding means operatively associated with said driven wheel means for selectively variably applying a selected resistance load to said driven wheel means.

7. The invention as defined in claim 1 and wherein said upwardly extending support means comprising:

spaced vertically extending members; and shaft means mounted between and rotatably supported by said members for supporting said driven wheel means and said flywheel means and said variable resistance load applying means.

8. The invention as defined in claim 1 and further comprising:

adjustment means associated with said support stand means for enabling mounting of bicycles of different sizes.

9. The invention as defined in claim 1 and wherein:

said driven wheel means and said flywheel means and said variable resistance load applying means being generally located between the rear wheel and the crank arms and pedals and being located generally beneath the seat of a bicycle mounted on said support stand means.

10. The invention as defined in claim 9 and further comprising:

shaft means mounted on said support stand means for rotatably supporting said flywheel means and said variable resistance load applying means and said driven wheel means and being located below a horizontal plane including a crank hub support means.

11. The invention as defined in claim 10 and wherein said shaft means comprising:

a first shaft means located directly beneath said crank hub support means for rotatably supporting said flywheel means and said variable resistance load applying means;

a second shaft means located rearwardly of said first shaft means for rotatably supporting said driven wheel means; and drive means operatively connecting said driven wheel means to said flywheel means and said variable resistance load applying means for causing rotative movement thereof.

12. The invention as defined in claim 11 and further comprising:

support arm means pivotally mounted on said first shaft means and extending rearwardly thereof and mounting said second shaft means for selective pivotal upward and downward adjustment to selectively variously upwardly and downwardly position said driven wheel means to accomodate bicycles of different sizes.

13. The invention as defined in claim 12 and further comprising:

selectively adjustable support means connected to said support arm means for selectively positioning said support arm means and said driven wheel means relative to the rear wheel of a bicycle.

14. The invention as defined in claim 10 and wherein:

the axis of rotation of said driven wheel means being located below the axis of rotation of the rear wheel a distance slightly less than the diameter of the rear wheel and being located slightly forwardly of the axis of rotation of the rear wheel in relatively close proximity to the lowermost portion of the rear wheel whereby driving engagement between the rear wheel is effected—relatively closely adjacent the lowermost portion of the rear wheel which engages the ground during actual riding of a bicycle.

15. The invention as defined in claim 10 and further comprising:

drive means operatively connecting said driven wheel means and said flywheel means and said variable resistance load applying means for causing rotation of said flywheel means and said variable resistance load applying means at velocities directly proportional to the rotational velocity of said driven wheel means.

16. The invention as defined in claim 15 and further comprising:

pivotal support arm means pivotally mounted on said shaft means and extending rearwardly therefrom for pivotal adjustable movement relative thereto;

rotational mounting means for said driven wheel means being rearwardly located on said pivotal support arm means in juxtaposition to the rear wheel of a bicycle and being movable between various adjusted positions for driving engagement with various size bicycle rear wheels; and adjustment means operatively associated with said pivotal support arm means for selectively variably positioning said driven wheel means.

17. The invention as defined in claim 1 and wherein:

the exercising apparatus being constructed and arranged for simulating the characteristics of exercise during the actual riding of a bicycle; and said flywheel means being calibrated and designed and having a mass sufficient for storage of energy approximately equal to the momentum created by the weight of the rider and bicycle during actual bicycle riding at various speeds and constructed and arranged for continuous automatic variation of momentum in accordance with the operational speed of said manually operated movable drive means.

18. The invention as defined in claim 17 and wherein:

said variable resistance load applying means being further calibrated and designed for creating variable resistance loads approximately equal to resistance loads encountered during actual riding of a bicycle on terrain of varying grade, and being constructed and arranged for selective variation of applied resistance in accordance with selected variable grade conditions to be simulated.

19. The invention as defined in claim 18 and further comprising:

power output display means calibrated and designed for displaying power output characteristics in accordance with the amount of the resistance load applied by said variable resistance load applying means during use of the exercising apparatus.

20. The invention as defined in claim 19 and further comprising:

grade simulation selector means operatively connected to said variable resistance load applying means for selection of variable grade conditions to be simulated.

21. The invention as defined in claim 20 and wherein:

said grade simulation selector means being operatively connected to said power output display means for varying the power output characteristics displayed in accordance with the selected variable grade condition.

22. The invention as defined in claim 21 and further comprising:

speedometer means operatively associated with said movable drive means for displaying velocity approximately equal to velocity obtained during actual riding of a bicycle under the varying resistance loads applied by said variable resistance load applying means.

23. The invention as defined in claim 22 and wherein:

said speedometer means and said power output display means being constructed and arranged for correlating the power output characteristics displayed with velocity.

24. The invention as defined in claim 23 and wherein said power output display means comprising:

horsepower display means for displaying an indication of horsepower required during exercise at varying velocities and varying applied resistance loads.

25. The invention as defined in claim 24 and wherein said power output display means further comprising:

calory expenditure display means for displaying an indication of calories expended during exercise at varying velocities and varying applied resistance loads.

26. The invention as defined in claim 25 and comprising:

selected grade display means for displaying the % grade selected by operation of said grade simulation selector means 27. The invention as defined in claim 26 and further comprising:

housing means mounted on said support stand means for receiving said power output display means and said speedometer means and said grade simulation selector means.

28. The invention as defined in claim 27 and further comprising:

timer means mounted in said housing means for indicating exercising related time periods.

29. The invention as defined in claim 27 and further comprising:

air flow means mounted in said housing means for directing a flow of air toward the exerciser during exercising.

30. The invention as defined in claim 27 and further comprising:

maximum target heart rate display means mounted in said housing means for displaying maximum target heart rate information.

31. The invention as defined in claim 1 and wherein said first mounting means comprising:

vertically and horizontally adjustable support means for supportively receiving front wheel forks of bicycles of varying sizes.

32. The invention as defined in claim 31 and wherein said adjustable support means comprising:

upper and lower plate members mounted on an intermediate portion of said support post means in fixed spaced relationship and defining a pair of opposite parallel guide slots; and releasable and tightenable fork attachment and support means slidably adjustably retained in said guide slots for variable adjustable location therewithin.

33. The invention as defined in claim 32 and wherein:

said support post means having a polygonal cross-sectional configuration;

central opening means in said upper and lower plate members for receiving said support post means; and adjustable attachment means for adjustably attaching said upper and lower plate members on said support post means.

34. Exercising apparatus comprising:

manually operated movable drive means for manual operation by a person for exercise caused by resistance to motion thereof;

stationary support stand means for mounting said manually operative drive means;

fly wheel means operatively connected to said manually operated movable drive means for energy storage and continuous application of momentum force thereto during manual operation thereof;

a manually operable variable resistance loads applying means operatively connected to said manually operated drive means for continuously applying variable operator selected resistance loads thereto;

speed responsive resistance load changing means for automatically increasing and decreasing the resistance load applied to said manually operated movable drive means in accordance with the operational speed thereof;

the exercise apparatus being constructed and arranged to be operated by a bicycle having a pedal operated drive system providing said manually operated movable drive means; and said support stand means comprising:

an elongated lowermost horizontally extending tubular frame section having an elongated horizontally extending passage therewithin;

a front stabilizer device mounted on the forward end of said lowermost tubular frame section and extending laterally outwardly relative thereto;

a rear stabilizer device mounted on the rear end of said lowermost tubular frame section and extending laterally outwardly relative thereto;

an elongated forwardmost upwardly extending tubular frame section having an elongated upwardly extending passage therewithin mounted on the front end portion of said lowermost tubular frame section and being connected to said horizontally extending passage therewithin;

an instrument housing unit mounted on the upper end portion of said upwardly extending tubular frame section and being connected to said upwardly extending passage therewithin;

a vertically and horizontally adjustable bicycle front fork mounting device mounted on an intermediate portion of said upwardly extending tubular section;

a support housing section having a mounting chamber and being mounted on a central portion of said lowermost tubular framer section and extending upwardly therefrom;

a cradle member mounted on the upper end of said support housing section to supportively receive the crank hub of a bicycler;

a clamping device mounted on the upper end of said support housing section and being operatively associated with said cradle member to releasably clampingly engage to crank hub of a bicycle supported on said cradle member;

a shaft member centrally mounted in said mounting chamber on said support housing section;

said flywheel means being mounted on said shaft member in said mounting chamber within said support housing section and being rotatable therewithin; and said speed-responsive resistance load changing means comprising a fluid impeller device mounted on said shaft member in said mounting chamber within said support housing section and being rotatable therewithin.

35. The invention as defined in claim 34 and further comprising:

an access opening in the rear portion of said support housing section;

an elongated support arm device mounted on said shaft member and being adjustably pivotally movable relative thereto between upper and lower positions and extending rearwardly through said access opening; and a driven friction wheel member rotatably mounted on the rear end portion of said support arm device for rotatable driving engagement with the rear wheel of a bicycle mounted on said cradle member.

36. The invention as defined in claim 35 and further comprising:

a first pulley device operably associated with said driven friction wheel member;

a second pulley device operably associated with said flywheel member and said fluid impeller device; and a belt member operably associated with said first pulley device and said second pulley device to cause said driven friction wheel member to drive said flywheel member and said fluid impeller device.

37. The invention as defined in claim 36 and further comprising:

an adjustable support device mounted on said lowermost frame section and being operatively associated with said support arm device to variably upwardly and downwardly adjustably position said support arm device and said driven friction wheel member relative to the bicycle wheel.

38. The invention as defined in claim 37 and further comprising:

an adjustable variable friction device mounted in said chamber in operative association with said flywheel member to apply variable frictional resistance loads thereto.

39. The invention as defined in claim 38 and further comprising:

a resistance load control device mounted on said instrument housing unit; and a resistance control cable device mounted in said upwardly extending passage and said horizontally extending passage and being operatively connected to said control device and said adjustable variable friction device.

40. The invention as defined in claim 39 and further comprising:

a speedometer unit mounted on said instrument housing unit;

a speedometer actuating device mounted in said chamber in operative association with said flywheel member; and a speedometer control cable mounted in said upwardly extending passage and said horizontally extending passage and being operatively connected to said speedometer actuating device and said speedometer unit.

41. The invention as defined in claims 15 or 34 and wherein said speed-responsive resistance load changing means being mounted on said flywheel means.

42. The invention as defined in claim 41 and wherein said speed-responsive resistance load changing means further comprising a plurality of fan blade members mounted on said flywheel means.

43. The invention as defined in claim 42 and wherein said flywheel means further comprising:

a cylindrical member having a cylindrical peripheral surface and opposite annular side surfaces; and said fan blade members being mounted on one of said side surfaces.

44. The invention as defined in claim 17 or 34 and wherein:

said flywheel means being further constructed and arranged to have a moment of inertia of approximately 3.0 or less pounds feet seconds squared.

45. The invention as defined in claim 44 and wherein:

said flywheel means having a moment of inertia between approximately 3.0 and 0.02 pounds feet seconds squared.

46. The invention as defined in claim 17 or 34 and wherein:

said flywheel means and said drive means being constructed and arranged to have a velocity increase ratio of at least 10:1 or more.

47. The invention as defined in claim 46 and wherein:

the velocity increase ratio being at least approximately 50:1.

48. The invention as defined in claim 47 and wherein:

said flywheel means having a weight of approximately 50 pounds or less.

49. The invention as defined in claim 48 and wherein:

the weight of said flywheel means being between approximately 5 and 20 pounds.

50. The invention as defined in claim 49 and wherein:

said flywheel means having a diameter of approximately 30 inches or less.

51. The invention as defined in claim 50 and wherein:

said flywheel means having a diameter of approximately 8 inches, a weight of approximately 14 pounds, and a moment of inertia of approximately 0.02 pounds feet second squared.

* * * * *